US005138389A

United States Patent [19]

Randall

[11] Patent Number: 5,138,389

[45] Date of Patent: Aug. 11, 1992

[54] IMAGING APPARATUS UTILIZING INTERMEDIATE TRANSFER MEMBER

[75] Inventor: Kent A. Randall, Webster, N.Y.

[73] Assignee: Eastman Kodak Company, Rochester, N.Y.

[21] Appl. No.: 601,538

[22] Filed: Oct. 22, 1990

[51] Int. Cl.[5] ..... G03G 15/14

[52] U.S. Cl. ..... 355/272; 355/271; 355/277; 355/326

[58] Field of Search ..... 355/271-274, 355/277, 281, 326-328, 23-24, 26, 90

[56] References Cited

U.S. PATENT DOCUMENTS

| | | | |
|---|---|---|---|
| 3,580,670 | 5/1971 | Bhagat | 355/23 X |
| 3,775,102 | 11/1973 | Punnet | 355/230 X |
| 3,936,171 | 2/1976 | Brooke | 355/271 |
| 4,078,787 | 3/1978 | Burlew et al. | 355/207 X |
| 4,194,829 | 3/1980 | Cavagnaro | 355/319 |
| 4,194,832 | 3/1980 | Tabayashi | 355/23 X |
| 4,410,897 | 10/1983 | Moriguchi et al. | 355/23 X |
| 4,413,898 | 11/1983 | Anne | 355/24 X |
| 4,427,285 | 1/1984 | Stange . | |
| 4,714,939 | 12/1987 | Ahern et al. | 355/275 |
| 4,958,187 | 9/1990 | Tsuchiya et al. | 355/23 X |
| 5,070,369 | 12/1991 | Mahoney et al. | 355/271 |
| 5,070,371 | 12/1991 | Randall | 355/272 |
| 5,070,372 | 12/1991 | Randall | 355/272 |

FOREIGN PATENT DOCUMENTS

| | | | |
|---|---|---|---|
| 1526226 | 9/1978 | United Kingdom | 355/24 |
| 8702792 | 5/1987 | World Int. Prop. O. | 355/271 |

OTHER PUBLICATIONS

*Xerox Disclosure Journal*, vol. 9, No. 1, Jan./Feb. 1984, Andrews, Ronald A., "Single Pass Duplex in Electronic Systems".

*Primary Examiner*—A. T. Grimley
*Assistant Examiner*—Matthew S. Smith
*Attorney, Agent, or Firm*—Leonard W. Treash, Jr.

[57] ABSTRACT

Imaging apparatus includes a primary image member upon which first and second toner images are formed and an intermediate image member to which the first toner image is transferred. Duplex imaging is accomplished by transferring the second toner image from the primary image member to one side of a receiving sheet and the first toner image from the intermediate image member to the other side of the sheet. The intermediate image member extends toward a fuser to transport the receiving sheet to the fuser while the first image is being transferred. Both images are transferred to the receiving sheet while not being backed by the other image member.

4 Claims, 2 Drawing Sheets

IMAGING APPARATUS UTILIZING INTERMEDIATE TRANSFER MEMBER

RELATED APPLICATIONS

This application is related to co-assigned:

U.S. patent application Ser. No. 07/601,539, filed Oct. 22, 1990, METHOD AND APPARATUS FOR HANDLING TONER IMAGES, in the name of Kent A. Randall.

U.S. patent application Ser. No. 07/601,630, filed Oct. 22, 1990, MULTIPURPOSE IMAGING APPARATUS, in the name of Kent A. Randall.

U.S. patent application Ser. No. 07/601,629, filed Oct. 22, 1990, A METHOD AND APPARATUS FOR FORMING COMBINED TONER IMAGES, in the name of Kent A. Randall.

TECHNICAL FIELD

This invention relates to electrostatographic apparatus utilizing an intermediate toner image transfer member to which toner images are transferred from a primary imaging member before being transferred to a receiving sheet.

BACKGROUND ART

U.S. Pat. No. 4,078,787 shows a commercially known electrophotographic high volume copier in which a photoconductive belt is entrained around a series of rollers. Toner images are formed on the belt electrophotographically and are transferred to a receiving sheet which is brought into contact with and carried by the belt for a portion of its path. The belt is entrained about a one-inch roller just after the transfer station. The receiving sheet has a tendency not to follow the photoconductive belt as it goes around the small roller and is picked up by a transport belt, one edge of which is positioned just above the small roller. The transport belt holds the non-image bearing side of the receiving sheet and transports it away from the photoconductive belt to a fixing device, for example, a roller fuser.

U.S. Pat. No. 4,714,939, Ahern et al, issued Dec. 22, 1987, also shows a high volume copier. However, in order to do duplex copying with a straight receiving sheet path and less handling, an intermediate transfer roller or belt is positioned in transfer relation with a photoconductive belt. A first toner image is transferred to the intermediate member and the receiving sheet is fed between the photoconductive belt and the intermediate member. The first image is transferred to the top side of the receiving sheet and a second toner image is transferred to the bottom side of the receiving sheet directly from the photoconductive belt. With this approach, duplex images can be formed on a receiving sheet with the receiving sheet passing through a straight paper path. Because toner images are electrostatically transferred in opposite directions to opposite sides of the same sheet, the intermediate roller or belt is positioned to separate from contact with the photoconductive belt before the second toner image is transferred to the receiving sheet from the photoconductive belt. This reduces the tendency of the second transfer to affect the toner image already on the receiving sheet. For a variation of this duplexing approach, see also U.S. Pat. No. 4,688,925, Randall, issued Aug. 25, 1987.

A number of references describe a process for making two (or more) color images by creating an electrostatic image and toning the electrostatic image in the presence of a previously created toner image of a different color. U.S. patent application Ser. No. 07/341,452 to Ahern, filed Apr. 21, 1989, and entitled "Color Duplex Reproduction Method and Apparatus", discloses using that process with an intermediate belt or roller to do multicolor duplex toner images using a straight paper path.

U.S. Pat. No. 4,194,829, W. A. Cavagnaro, issued Mar. 25, 1980, is representative of a number of patents which show making duplex copies by transferring a first toner image to one side of a receiving sheet, turning the sheet over without disturbing the first image, transferring a second image to the opposite side and transporting the sheet to a fuser without disturbing either image. Both images are fused simultaneously. Transporting the sheet to the fuser without disturbing the loose toner images is a challenge in this approach which has been solved commercially for most types of receiving sheets using quite sophisticated transporting devices. In all of the above references suggesting use of intermediates to do duplex, a receiving sheet must also be transported to the fuser with a transport device that does not disturb unfixed fuser images on both sides of the sheet.

STATEMENT OF THE INVENTION

It is an object of the invention to simplify a duplex copier or printer that has a generally straight receiving sheet path along which toner images are transferred to opposite sides of a receiving sheet.

This object is accomplished by the use of an intermediate member for duplex which member also functions as a transport mechanism for transporting a receiving sheet after it leaves a primary image member, for example, transports it to a fuser.

According to a preferred embodiment, during such transport of a receiving sheet away from the primary image member a toner image is transferred from the intermediate member to the receiving sheet. In this embodiment transfer of each toner image does not affect the other toner image.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
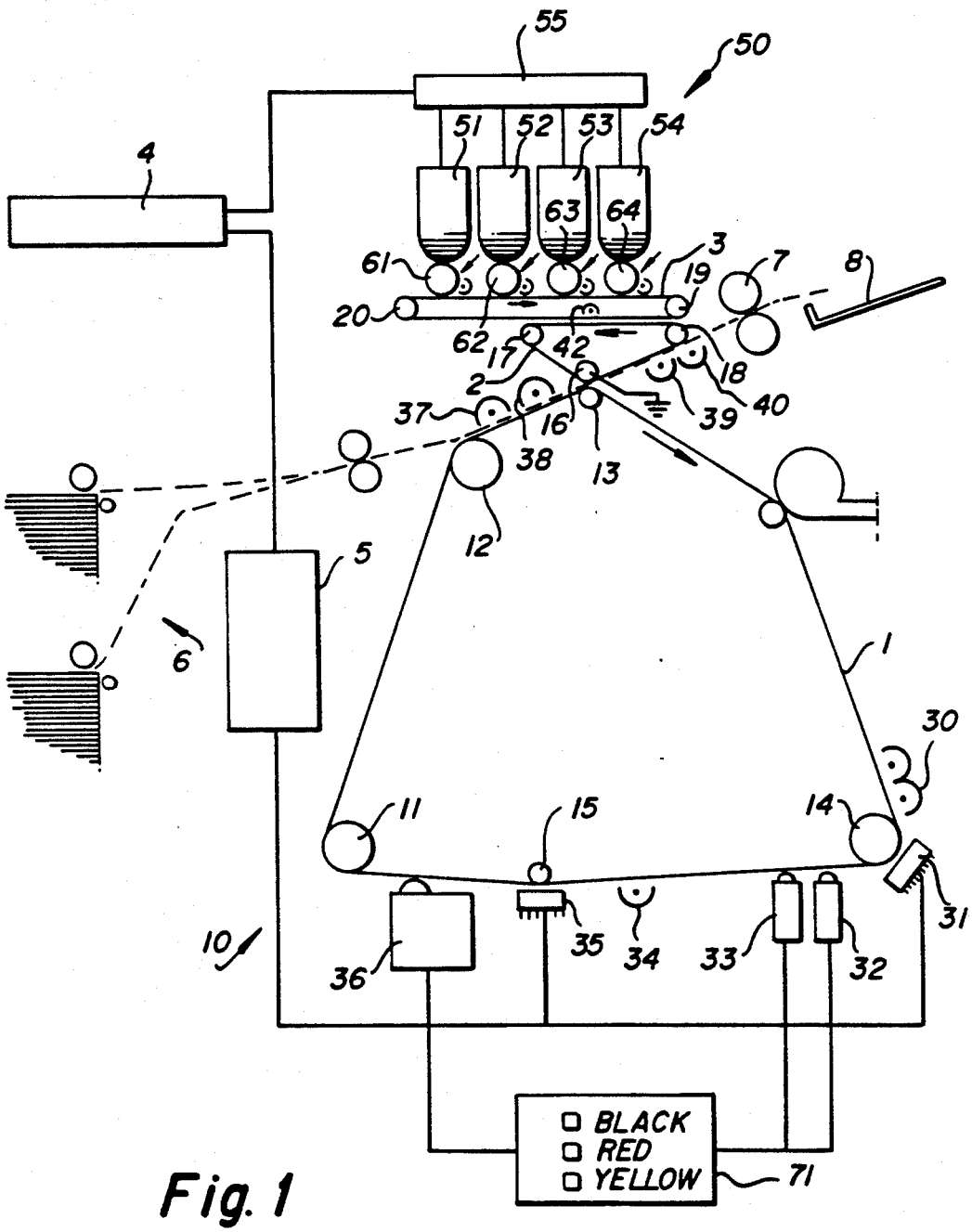
FIG. 1 is a side schematic of a multipurpose imaging apparatus utilizing the invention.

According to FIG. 1, a multipurpose imaging apparatus includes a high volume duplex copier or printer portion 10 and a full color portion 50. The copier or printer portion 10 is of primary interest in describing this invention. It includes a primary image member, for example, photoconductive belt 1, which is entrained about a series of rollers including rollers 11, 12, 13, 14 and 15 and is driven by one of said rollers past a series of known electrophotographic stations.

In single color operation, primary image member 1 is uniformly charged by a primary charger 30 and imagewise exposed at an exposure station, for example, LED electronic exposure station 31 to create a series of electrostatic images. The images are toned by a heavy-duty toning station 36, which may contain a large supply of black toner for heavy-duty, high-volume use.

In simplex operation, a receiving sheet is fed from a receiving sheet supply 6 to a transfer station including a transfer corona charger 37 where a toner image is transferred from primary image member 1 to the bottom-side of the receiving sheet. The receiving sheet passes a detack charger 38 and separates from primary image member 1 as primary image member 1 moves around a small roller 13. The receiving sheet is electrostatically attracted to an intermediate image member 2 which in this application is functioning to transport the receiving sheet to a duplex fuser 7 which fixes the image on the receiving sheet and deposits the sheet in an output tray 8.

Intermediate image member 2 is entrained about rollers 16, 17 and 18. Roller 16 is positioned sufficiently close to roller 13 supporting primary image member 1 that primary image member 1 and intermediate image member 2 are in transfer relation with each other.

In the duplex mode, instead of transferring a first toner image to a receiving sheet, it is transferred to intermediate image member 2 utilizing the strength of an electric field created between rollers 13 and 16. A transfer sheet is fed into contact with primary image member 1 as the second image approaches transfer charger 37. The second toner image is transferred to the bottom-side of the transfer sheet by transfer charger 37 and the top side of the receiving sheet adheres to intermediate image member 2 as primary image member 1 passes around roller 13. The receiving sheet now overlies the first toner image on intermediate image member 2. A second transfer corona charger 39 is biased to a polarity which transfers the first toner image to the topside of the receiving sheet from intermediate image member 2. The sheet passes a detack charger 40 and separates from intermediate image member 2 as the intermediate image member passes around roller 18. The sheet then moves into duplex fuser 7 where both images are simultaneously fused.

In the duplex mode, the intermediate image member 2 serves the function both of an intermediate transfer member and as a transport device for transporting the receiving sheet to the fuser. This transport device is much less complicated than one transporting a sheet that already contains two unfixed toner images. Transfer of the first toner image to the receiving sheet is carried out at a position removed from the primary image member 1. Thus, the electrostatic field created by transfer charger 39 does not adversely affect the second toner image already on the bottomside of the receiving sheet. Without the presence of primary image member 1, the second toner image on the bottomside of the sheet has nowhere to go while the first toner image is being transferred to the topside. Note also that the second toner image was transferred to the receiving sheet by transfer charger 37 at a position at which the sheet was not backed by intermediate member 2; thus, the first toner image is not affected by the transfer of the second toner image.

Primary image member 1 can also be used to make two-color reproductions, either simplex or duplex. In this mode, primary image member 1 is first charged by primary charging station 30 and imagewise exposed by exposure station 31 to create a first electrostatic image. The first electrostatic image is toned by one of toner stations 32 or 33. Toning stations 32 and 33 have different highlight colors, for example, red and yellow. A color control 71 permits the operator to select which color is used to tone the first electrostatic image. Assuming station 32 has red toner and is selected, a red toner image is formed corresponding to the electrostatic image created by exposure station 31.

Primary image member 1 is then recharged by a secondary charging station 34 (primarily to equalize the charge in the toned and untoned areas) and is again imagewise exposed by a second exposure station 35, which may also be an LED electronic exposure station, to create a second electrostatic image in the same general area (i.e., the same frame) as the red toner image. Black toner is now applied from primary toning station 36 utilizing known toning technology which does not clean off the red toner image thereby creating a two-color image of red and black. If toning station 33 is used, the image will be yellow and black. This system is known in the art and is best utilized with electronic exposure and discharged area toning systems in creating highlight color reproductions. In this mode, consecutive two-color images can be formed. Utilizing intermediate image member 2, they can be transferred to opposite sides of a receiving sheet to create duplex two-color reproductions.

Single color images can also be formed by toning stations 32 and 33 as selected by the operator using color control 71 to pick either red or yellow without black. Three color images could be formed with additional charging and exposure stations.

The full-color portion 50 of the multipurpose imaging apparatus shown in FIG. 1 also uses the intermediate image member 2. As shown in FIG. 1, four separate single color toner images are created on separate photoconductive drums 61, 62, 63 and 64 by separate image-forming modules 51, 52, 53 and 54 which include a corona charger, a laser exposure device and a single color toning device for each of drums 61, 62, 63 and 64.

The separate toner images which are conventionally cyan, magenta, yellow and black toner images are transferred in registration to a secondary image transfer member 3 to form a four-color toner image thereon. Secondary image transfer member 3 is entrained about rollers 19 and 20 and is positioned in transfer relation with intermediate image member 2.

In operation, the four-color image formed on member 3 is transferred by a transfer corona charger 42 to intermediate image member 2. From intermediate image member 2 the four-color toner image is transferred to a receiving sheet utilizing duplex transfer charger 39 as in the duplex mode with copier/printer portion 10.

Electronic exposure is used in both portions 10 and 50. The information for such exposure can come from any conventional printer source, for example, a suitable memory, a computer or a scanner. As shown in FIG. 1, a color scanner 4 feeds signals both to color image processing electronics 55 for portion 50 and to compiler 5 for portion 10. Obviously, two separate scanners could be used or either of the portions connected to some other electronic image source.

Note that in the duplex mode, images intended for opposite sides of a receiving sheet must be reversed when formed, because the images transferred to intermediate image member 2 go through an additional transfer with respect to those transferred directly from primary image member 1 to a receiving sheet. U.S. Pat. No. 4,714,939, Ahern, issued Dec. 22, 1987, shows optics for performing such an every-other-image reversal with an optical copier. However, if exposure is by electronic exposure devices, this reversal is accomplished by appropriate electronic programming.

Although the full-color portion 50 is shown with an intermediate member 3 which is separate from the intermediate image member 2, their functions can be merged into a single component. That is, the four toner images formed on drums 61, 62, 63 and 64 could be transferred directly to intermediate image member 2. This is a matter of design choice. For greatest efficiency of the high volume portion 10 of the apparatus, it is preferable that intermediate image member 2 be only one frame in length. It would be difficult to fit all four drums 61–64 in contact with an intermediate image member small enough to do small images from primary image member 1 at full machine speed. However, the intermediate image member could be made two frames in size to accommodate such direct transfer. With the image member two frames in size, the high volume portion 10 would operate at full efficiency for all duplex imaging except when a single two-sided receiving sheet is imaged, in which case one frame must be skipped. Note that if a multipage duplex document is being printed with a two-frame intermediate, the images would be printed in 2 sheet batches with two odd numbered pages (say, 1, 3) done before two even numbered pages (say, 2, 4), or vice versa. Note also that a "ledger" size image could be formed with its long dimension parallel to the path of movement or two "letter" size images could be formed with their long dimension across such path using a two-image intermediate member.

Figure 2:
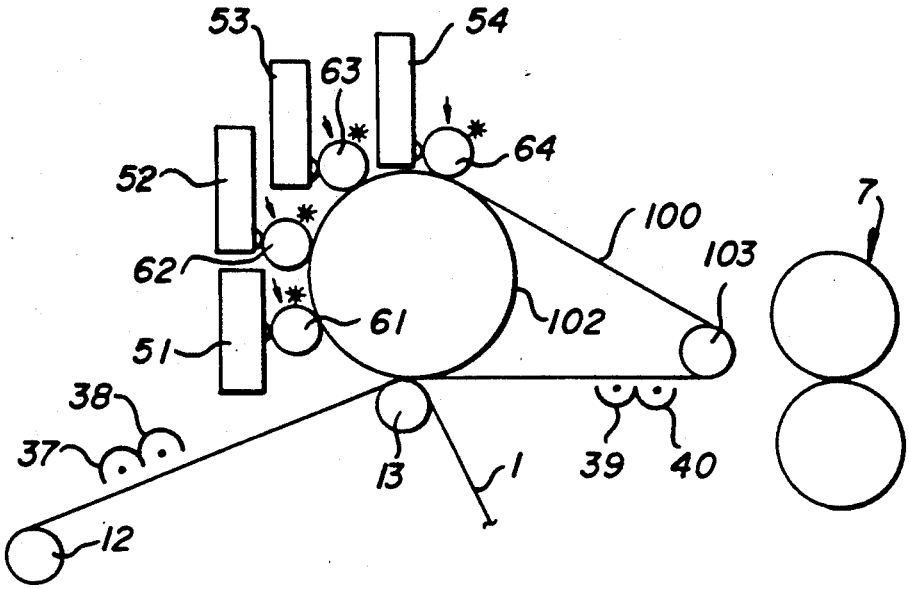
FIGS. 2 and 3 are side schematics of a portion of two alternative embodiments of the apparatus shown in FIG. 1.
Figure 3:
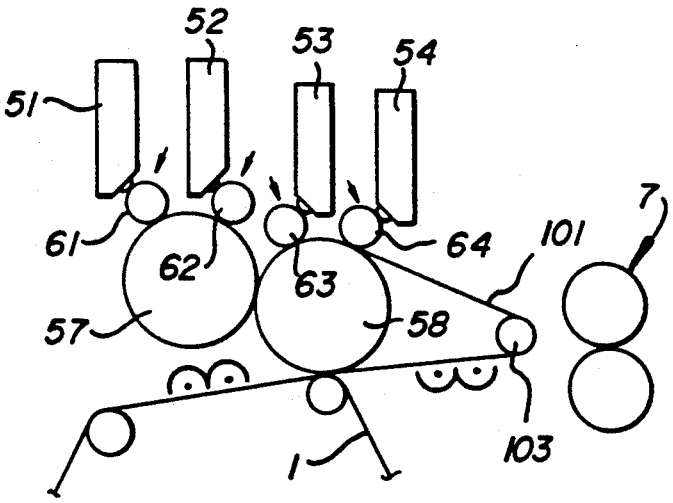

FIGS. 2 and 3 show alternative embodiments of the invention. According to FIG. 2, the intermediate image member is a web 101 trained around a large drum 102 and a small roller 103. All four color toner forming drums 61–64 are in transfer relation with web 101 where it is backed by large drum 102. This facilitates excellent cross track and skew registration of the color images. The web and small roller configuration facilitates transport of a transfer sheet to the fuser 7 and separation of the transfer sheet from web 101. The large drum and web increases the access time for a single duplex copy and requires doing imaging in an order other than the ordinary numerical order for greatest productivity.

FIG. 3 shows an embodiment in which two drums 57 and 58 are used with the second one 58 supporting a web as in FIG. 2. This approach reduces the height of the apparatus and the length of web 101.

As shown in FIG. 3, first and second color toner images are transferred from photoconductive drums 61 and 62 in registration to drum 57 to create a two-color image. Single color toner images are also transferred from photoconductive drums 63 and 64 in registration to form a two-color image on web 101 where backed by drum 58. The two-color image on drum 57 is transferred to web 101 in registration with the two color image transferred from drums 63 and 64 to form a four color image which in turn is transferred to a receiving sheet being carried by web 101 between drum 58 and small roller 103. The receiving sheet is transported to the fuser by web 101.

In the FIGS. 2 and 3 embodiments, web 101 is the intermediate image member which is utilized with primary image member 1 to provide duplex reproductions as in the FIG. 1 embodiment and therefore must be equal in size to the pitch of the images (or an integer multiple of the images) on primary image member 1. Drums 57, 61, 62, 63 and 64 do not interfere with this process because transfer biases between those drums and web 101 are turned off when using image member 1 for primary imaging.

The invention has been described in detail with particular reference to a preferred embodiment thereof, but it will be understood that variations and modifications can be effected within the spirit and scope of the invention as described hereinabove and as defined in the appended claims.

I claim:

1. A duplex imaging apparatus comprising:

a primary image member, an intermediate image member, roller fuser means for simultaneously fixing images on opposite sides of a receiving sheet, means for forming first and second electrostatic images on said primary image member, means for toning said electrostatic images to form first and second toner images on said primary image member, means for transferring said first toner image to said intermediate image member, means for feeding a receiving sheet through a path in which one side of said receiving sheet passes through transfer relation with said primary image member and the other side passes through transfer relation with said intermediate image member, and means for transferring said second toner image from said primary image member to one side of a receiving sheet fed along said path and means for transferring said first toner image from said intermediate image member to the other side of said receiving sheet, characterized in that said intermediate image member extends away from said primary image member downstream of said primary image member to transport a receiving sheet away from said primary image member to said fuser, and said first toner image is transferred to said receiving sheet at a position where said receiving sheet is not backed by said primary image member and said intermediate image member extends toward said fuser, and said means for transferring said second toner image to said receiving sheet is positioned to transfer said second toner image, where said receiving sheet is not backed by said intermediate image member.

2. Apparatus according to claim 1 wherein said means for transferring said first toner image to said receiving sheet is a corona charger positioned on the opposite side of said sheet from said intermediate image member and said means for transferring said second toner image to said receiving sheet is a corona charger positioned on the opposite side of said receiving sheet from said primary image member.

3. A duplex imaging apparatus comprising:

a primary image member, an intermediate image member, roller fuser means for simultaneously fixing images on opposite sides of a receiving sheet, means for forming first and second electrostatic images on said primary image member, means for toning said electrostatic images to form first and second toner images on said primary image member, means for transferring said first toner image to said intermediate image member, means for feeding a receiving sheet through a path in which one side of said receiving sheet passes through transfer relation with said primary image member and the other side passes through transfer relation with said intermediate image member, and means for transferring said second toner image from said primary image member to one side of a receiving sheet fed along said path and means for transferring said first toner image from said intermediate image member to the other side of said receiving sheet, characterized in that said intermediate image member extends away from said primary image member downstream of said primary image member to transport a receiving sheet away from said primary image member to said fuser, and said first toner image is transferred to said receiving sheet at a position where said receiving sheet is not backed by said primary image member and said intermediate image member extends toward said fuser and further wherein both said primary image member and said intermediate image member are endless belts entrained about a series of rollers, one of said rollers about which said primary image member is entrained is a roller sufficiently small that said receiving sheet tends not to follow the primary image member therearound and one of the rollers about which said intermediate image member is entrained is positioned adjacent said small roller to attract a receiving sheet as said primary image member passes around said small roller.

4. Apparatus according to claim 3 wherein said means for transferring said first toner image to said intermediate image member is an electrical field created between said adjacent rollers.

* * * * *